United States Patent [19]

Meyer

[11] Patent Number: 4,669,663

[45] Date of Patent: Jun. 2, 1987

[54] LARGE VOLUME SPRINKLER HEAD WITH PART-CIRCLE STEP BY STEP MOVEMENTS IN BOTH DIRECTIONS

[75] Inventor: Larry P. Meyer, Walla Walla, Wash.

[73] Assignee: Nelson Irrigation Company, Walla Walla, Wash.

[21] Appl. No.: 726,382

[22] Filed: Apr. 23, 1985

[51] Int. Cl.[4] ..... B05B 3/06; B05B 3/14

[52] U.S. Cl. ..... 239/230; 239/232; 239/233; 239/252; 239/DIG. 1

[58] Field of Search ..... 239/230, 231, 232, 233, 239/251, 252, DIG. 1

[56] References Cited

U.S. PATENT DOCUMENTS

| | | | |
|---|---|---|---|
| 2,816,798 | 12/1957 | Royer | 239/230 |
| 2,877,053 | 3/1959 | Kennard | 239/233 |
| 2,928,608 | 3/1960 | Royer | 239/230 |
| 3,051,396 | 8/1962 | McElhenie | 239/230 |
| 3,559,887 | 2/1971 | Meyer | 239/233 |
| 4,153,202 | 5/1979 | Meyer | 239/230 |
| 4,193,548 | 3/1980 | Meyer | 239/230 |
| 4,342,424 | 8/1982 | Meyer | 239/233 |
| 4,537,356 | 8/1985 | Lawson | 239/230 |

*Primary Examiner*—Andres Kashnikow

*Assistant Examiner*—Mary Beth O. Jones

*Attorney, Agent, or Firm*—Cushman, Darby & Cushman

[57] ABSTRACT

A large capacity agricultural irrigation sprinkler head of the rotary step by step impulse type operating in a part-circle mode with a step by step reversing movement. The sprinkler head embodies an improved sprinkler body including an elongated barrel leading to the outlet having a longitudinal axis intersecting (1) at an included angle greater than 90° with the rotational axis of the sprinkler body and (2) at an angle of 90° with the pivotal axis of the impulse arm assembly at a position spaced outwardly in a downstream direction from the intersection thereof with the sprinkler body rotational axis. The impulse arm is mounted by a yoke pivotally mounted on the barrel about an axis constituting the pivotal axis of the impuse arm for movement between first and second operating positions corresponding to the first and second operating positions of the impulse arm and pivotally connecting with the impulse arm about an axis constituting the oscillating axis of the impulse arm. The oscillating axis of the impulse arm is disposed above the longitudinal axis of the barrel and spaced outwardly of the yoke pivotal axis in a downstream direction.

13 Claims, 13 Drawing Figures

LARGE VOLUME SPRINKLER HEAD WITH PART-CIRCLE STEP BY STEP MOVEMENTS IN BOTH DIRECTIONS

This invention relates to agricultural sprinkler irrigation and more particularly to large volume sprinkler heads of the rotary step by step type capable of being operated in a reversing partcircle mode.

The type of large volume sprinkler head herein contemplated is exemplified by the disclosure contained in U.S. Pat. No. 3,559,887 which issued Feb. 2, 1971. The sprinkler head disclosed in this patent has been commercialized successfully since the issuance of the patent with various improvements being embodied throughout the years, such as exemplified in U.S. Pat. Nos. 3,744,720, 4,153,202, 4,193,548, and 4,342,424. In all of these sprinkler heads, the part-circle mode of operation included a cycle having an operative or forward step by step rotary movement through the part-circle arc of travel and a rapid continuous reverse movement through the arc of travel. In all of the sprinkler heads, the step by step rotary movement is obtained by an impulse arm carrying a reactant element which is movable through successive oscillatory cycles of movement during each of which the reactant element engages the stream. During engagement, an arm oscillating impulse force is created in a direction tangential to the oscillatory axis of the impulse arm which serves to continue its oscillatory cycling and a sprinkler body turning impulse force is created in a direction tangential to the rotational axis of the sprinkler body to effect the incremental rotary movements thereof. A separate reversing reactant element is provided which achieves continuous reversing movement by engaging the separate reversing reactant element continuously into the stream.

This type of rapid continuous reversing action presents two undesirable effects. First, if for some reason the reverse reactant element is in a position to be engaged by the stream when the stream is initially established, there exists the possibility that the sprinkler head will be moved in a reverse direction with an undesirable rapid velocity which can cause damage to the sprinkler head and possibly to attendants in close proximity thereto. The second disadvantage is that when the head is moved through a continuous relatively rapid rotational movement, the reach of the stream within the pattern is severely reduced thus detrimentally effecting the overall water distribution pattern.

It has now been found that these disadvantages can be obviated by accomplishing the reverse movement in a step by step manner similar to the forward movement in the opposite direction. Small volume sprinkler heads operating basically on this principle have been proposed in the patented literature since 1957. See, for example, U.S. Pat. No. 2,816,798. Additional patents along these lines include U.S. Pat. Nos. 2,877,053, 2,928,608 and 3,051,396. The present invention deals with improvements which have been found necessary and advantageous to embody in a large volume sprinkler head in order to effectively incorporate this step by step mode of operation in both directions exemplified in the earlier patents which, to applicants knowledge, have never been commercially practiced to any publicly recognizable extent.

In accordance with the principles of the present invention a basic improvement relates to a particular manner in which the impulse arm is mounted on the elongated barrel structure leading to the outlet which forms a part of the sprinkler body. More specifically, it is important that the mount for the impulse arm provide a pivotal axis which intersects the longitudinal axis of the elongated barrel utilized in the sprinkler body in an outwardly spaced relationship with respect to the intersection of the barrel axis with the vertical rotational axis of the sprinkler body. The spacing of the pivotal axis of the impulse arm is outwardly along the barrel in a downstream direction with respect thereto. Preferably, the pivotal axis is perpendicular to the longitudinal axis of the barrel. Preferably, the transversely extending oscillating axis of the impulse arm is spaced above the axis of the barrel and outwardly in a downstream direction with respect to the pivotal axis of the impulse arm. By mounting the impulse arm in the manner indicated above, the counterweight provided for controlling the oscillatory movements of the impulse arm can be brought into a manageable value.

That is, the amount of counterweight required can be minimized by minimizing the length of the impulse arm. Minimizing the amount of counterbalancing required and the length of the impulse arm both contribute toward lessening the weight that must be borne by the horizontally swinging sprinkler body barrel.

Another important improvement in accordance with the principles of the present invention is to form the drive spoon so that it embodies first and second angularly related reactant elements. It is important that each of these elements be constructed in accordance with the teachings contained in the U.S. Pat. No. 3,559,887 with respect to the single reactant element disclosed therein.

These and other improvements incorporating the principles of the present invention will become more apparent during the course of the following detailed description and appended claims.

The invention may best be understood with reference to the accompanying drawings wherein an illustrative embodiment is shown.

Figures 1, 2:
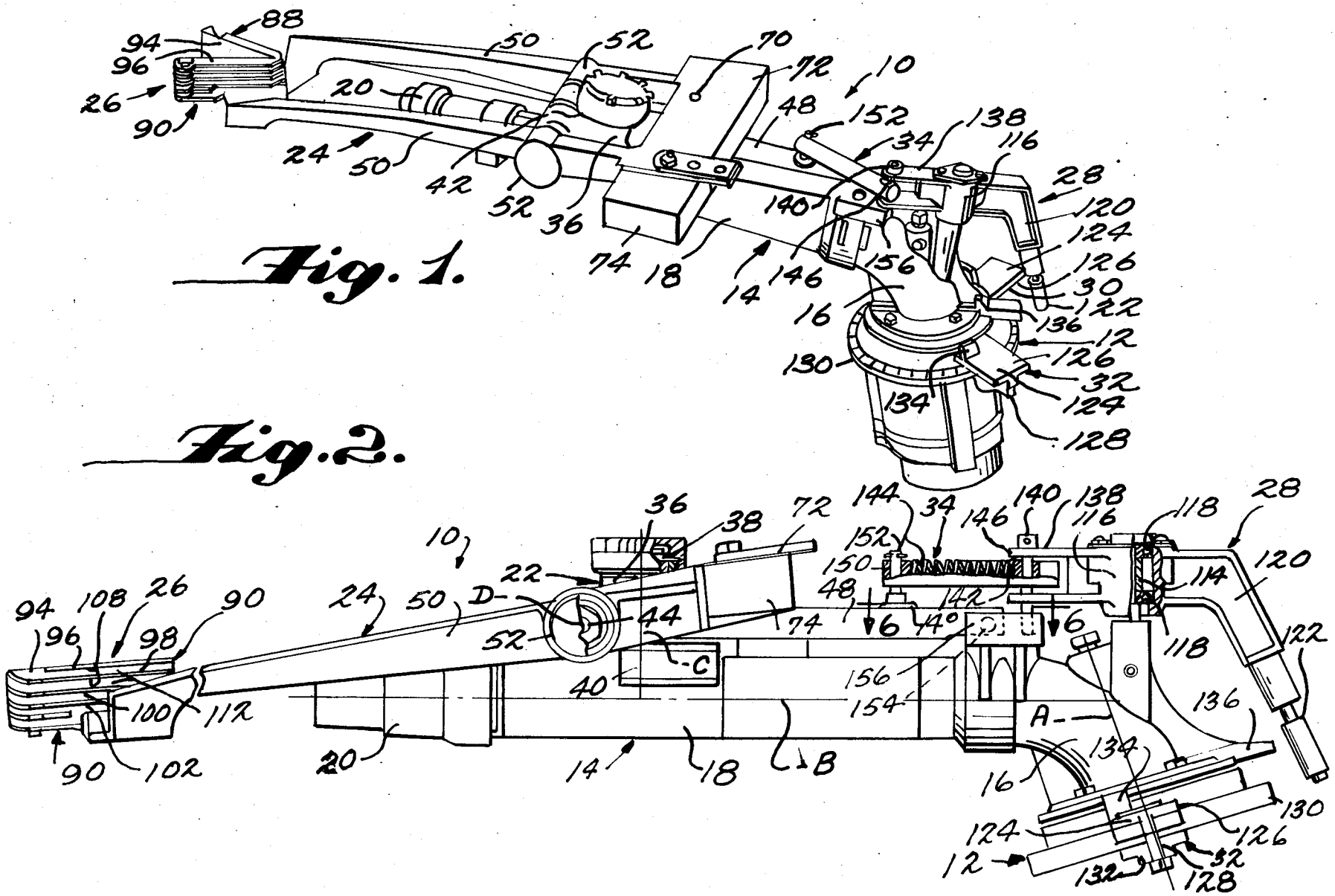
FIG. 1 is a perspective view of a sprinkler head embodying the principles of the present invention, showing the impulse arm assembly in a biased at rest position wherein upon operation a step-by-step rotation movement of the sprinkler body in a counterclockwise direction about its vertical rotational axis wil occur.
FIG. 2 is a side elevational view of the sprinkler head with certain components of the sprinkler body mounting assembly removed and certain parts broken away for purposes of clear illustration.

Referring now more particularly to the drawings, there is shown therein a sprinkler head, generally indicated at 10, which embodies the principles of the present invention. The sprinkler head 10 includes a stationary annular housing assembly 12 which is adapted to be fixedly mounted at its lower portion on a source pipe or the like (not shown) containing a source of water under pressure. Mounted within the annular housing assembly 12 for rotational movement about a fixed vertical axis coincident with the axis of the housing is a rotating sprinkler body assembly, generally indicated at 14. The fixed vertical axis is designated by the reference character A in FIG. 2. The annular housing assembly 12 including therein a brake and bearing arrangement (not shown) which serves to mount the sprinkler body assembly 14 on the annular housing assembly 12 for controlled rotational movement in either direction. The annular housing assembly 12 and the portion of the sprinkler body assembly 14 which is mounted therein together with the bearing and brake arrangement is preferably constructed in accordance with the teachings contained in commonly assigned U.S. Pat. No. 4,193,548, the disclosure of which is hereby incorporated by reference into the present specification.

The sprinkler body assembly 14 includes an elbow 16 fixed at one end to a lower sprinkler body tube (not shown) journaled within the housing assembly 12. The opposite end of the elbow 16 has an elongated barrel 18 fixed thereto. Fixed to the outlet end of the barrel 18 is a nozzle 20. It will be noted that the barrel 18 has a longitudinal axis, designated by the reference character B in FIG. 2, is disposed within a plane passing through the vertical axis of rotation A of the sprinkler body assembly 12. This plane also passes through the axis of the nozzle 20 which is coincidental with the axis B. The nozzle 20 serves to direct a stream of water in an upwardly and outward direction. The elbow 16 defines an included angle of 108 degrees between the axes A and B although other angles may be included, as for example 111° and 114°.

Mounted on the barrel 18 for pivotal movement about an axis B perpendicular to the axis of the barrel is a yoke, generally indicated at 22. The pivotal axis of the yoke is designated by the reference character C in FIG. 2. The yoke 22 is mounted for movement about the axis C for movement between first and second operating positions. The yoke 22 serves to mount an impulse arm assembly, generally indicated at 24, (1) for movement with the yoke 22 into two corresponding operating positions and (2) for oscillating movements about a transversely extending oscillatory axis designated by the reference character D in FIG. 2. The oscillatory axis D is disposed above the longitudinal axis B of the barrel 18 and in a position outwardly of the pivotal axis C of the yoke 22 or impulse arm assembly 24 in a down stream direction.

The impulse arm assembly 24 has mounted on its outward end a drive spoon, generally indicated at 26, which is constructed in accordance with the principles of the present invention. The drive spoon 26 is operable in either of the two operating positions of the yoke 22 or impulse arm assembly 24 and functions to effect continuous oscillatory cycles of the impulse arm assembly 24, during each one of which, the drive spoon 26 is moved into a position of engagement with the stream issuing from the nozzle 20. During engagement of the drive spoon 26 with the stream there is created two impulse forces, one an arm actuating impulse force which acts in a tangential direction to the oscillatory axis D of the impulse arm assembly 24 so as to achieve the continued oscillatory cycles thereof and the other a sprinkler body rotating impulse force which acts tangentially to the axis of rotation A of the sprinkler body assembly 14 to effect a controlled stepped movement thereof. The sprinkler body rotating impulse force acts in a clockwise direction to move the sprinkler body assembly 14 in a clockwise direction, as viewed from above, when the drive spoon 26 is in its first operating position. Conversely, the sprinkler body rotating impulse force acts in a counterclockwise direction, as viewed from above, when the drive spoon 26 is in its second operating position.

In order to change the direction of movement of the sprinkler body assembly 14 from clockwise to counterclockwise, or vice versa, there is provided an actuating assembly, generally indicated at 28, which is mounted on the elbow 16 for movement into two limiting positions. The actuating assembly 28 is carried with the sprinkler body assembly 14 during the rotational movement of the latter and the movement of the actuating assembly 28 between its limiting positions is effected by first and second stop assemblies, generally indicated at 30 and 32, adjustably mounted on the stationary housing assembly 12. In addition, an overcenter spring toggle mechanism 34 serves to transmit the movement of the actuating assembly 28 between its limiting positions to a movement of the yoke 22 between its first and second operating positions and to resiliently bias both into the positions which they have been moved.

Figure 3:
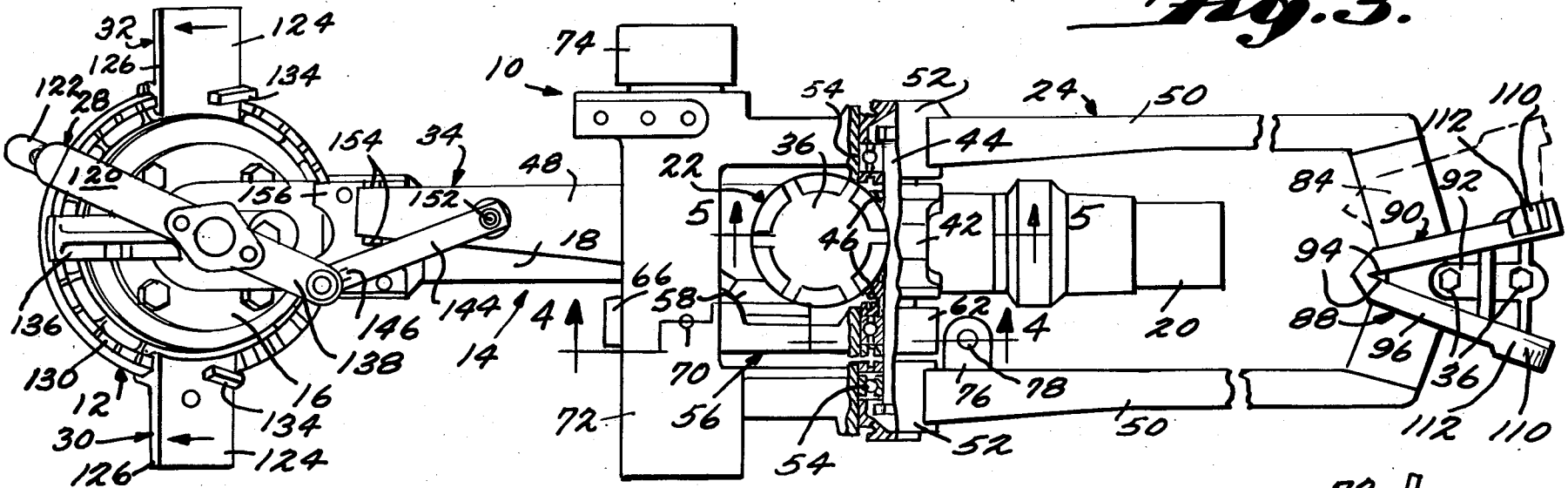
FIG. 3 is a top plan view of the structure shown in FIG. 2 again with certain parts broken away for purposes of clear illustration.
Figure 4B:
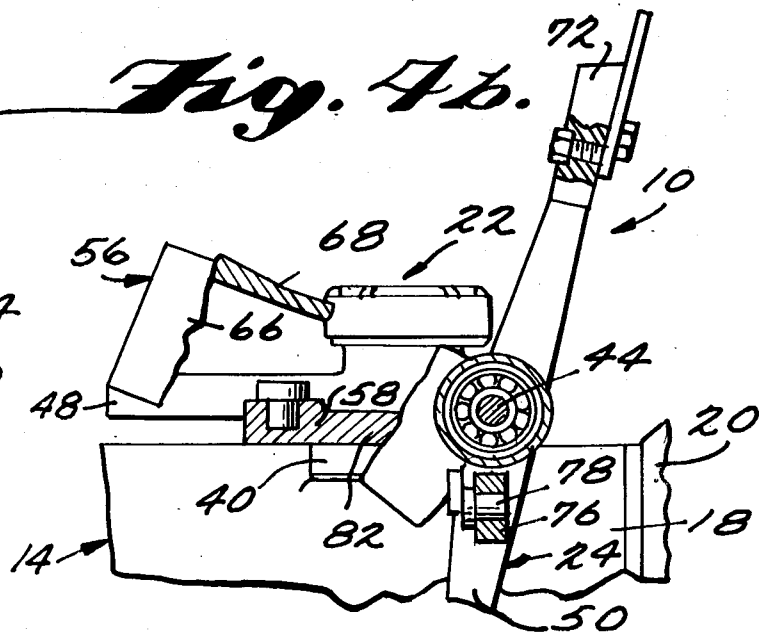
FIG. 4B is a view similar to FIG. 4A showing the position of the parts after the impulse arm has moved the counterweight a short distance.
Figure 4A:
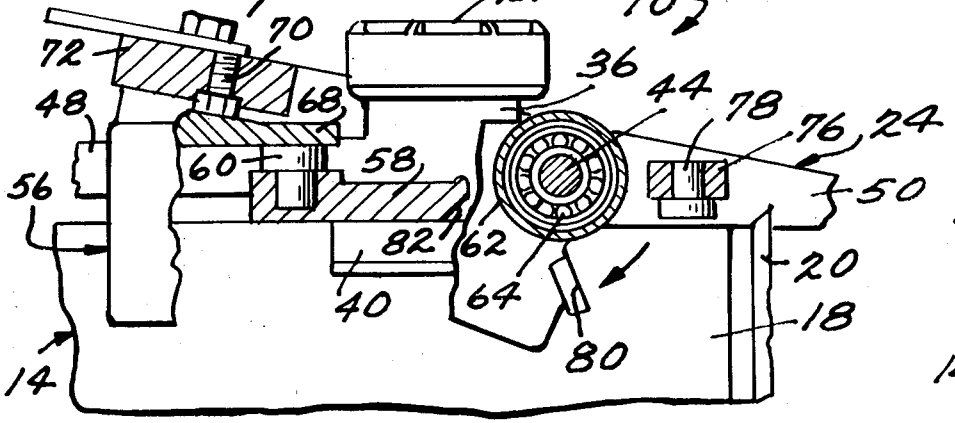
FIG. 4A is a fragmentary sectional view taken along the lines 4—4 of FIG. 3.
Figure 5:
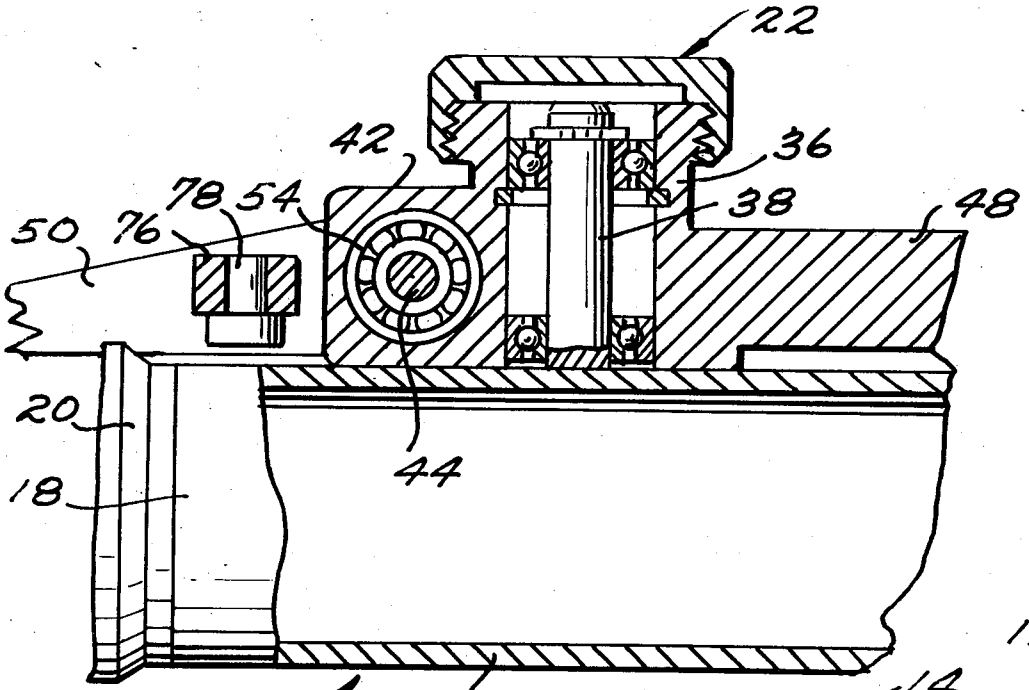
FIG. 5 is an enlarged fragmentary sectional view taken along the line 5—5 of FIG. 3.
Figure 6:
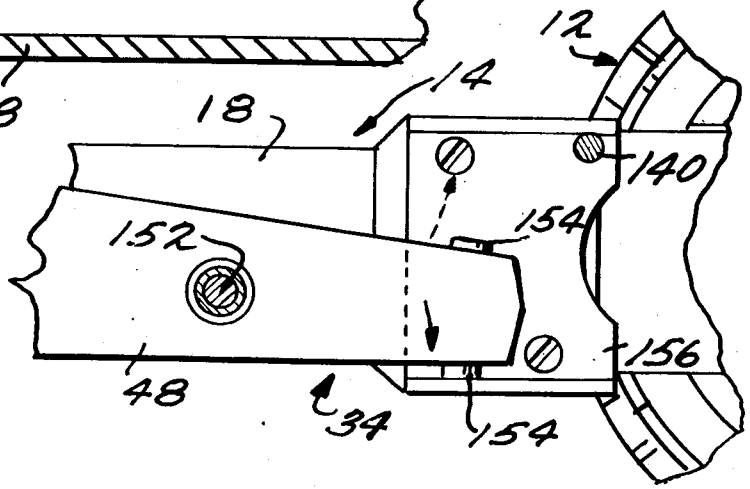
FIG. 6 is an enlarged fragmentary sectional view taken along the line 6—6 of FIG. 2.
Figure 7:
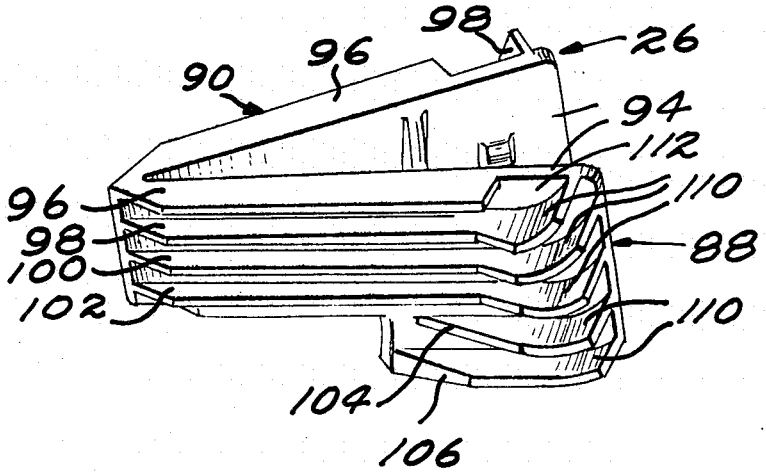
FIG. 7 is a perspective view of the drive spoon constructed in accordance with the principles of the present invention.
Figure 8:
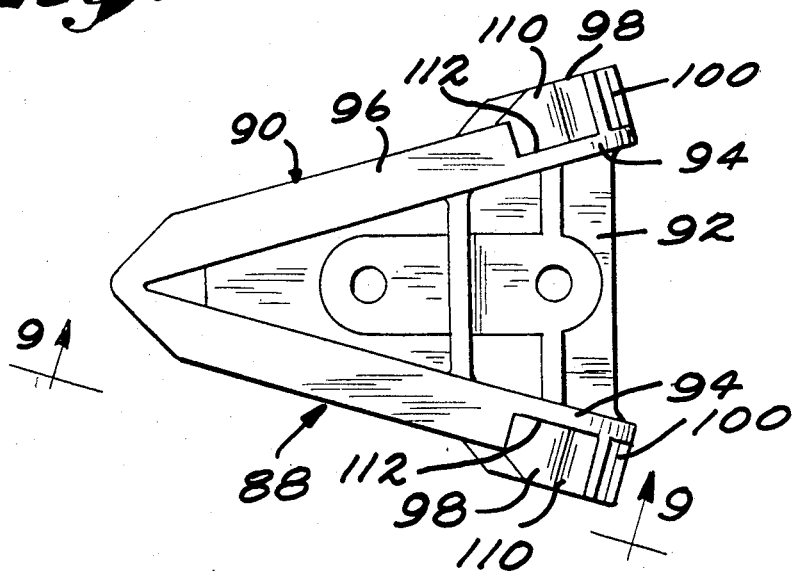
FIG. 8 is a top plan view of the drive spoon.
Figure 11:
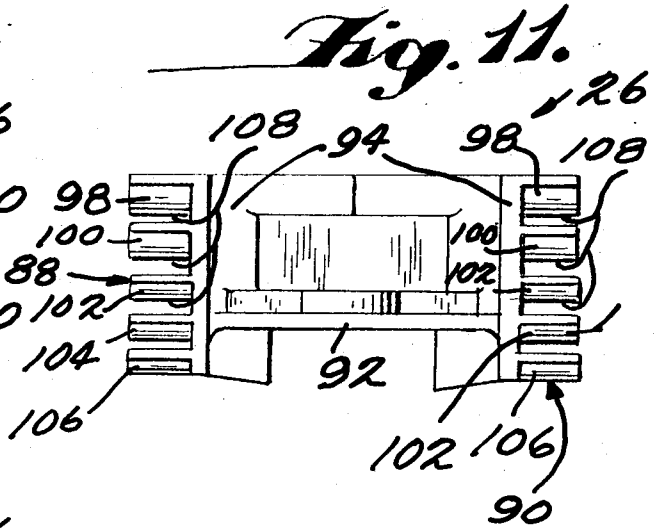
FIG. 11 is a rear elevational view of the drive spoon.
Figure 9:
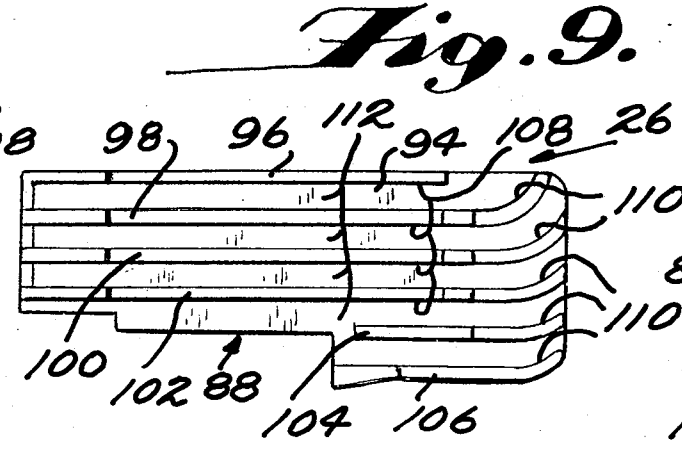
FIG. 9 is a side elevational view of the drive spoon viewed along the lines 9—9 of FIG. 8.
Figure 10:
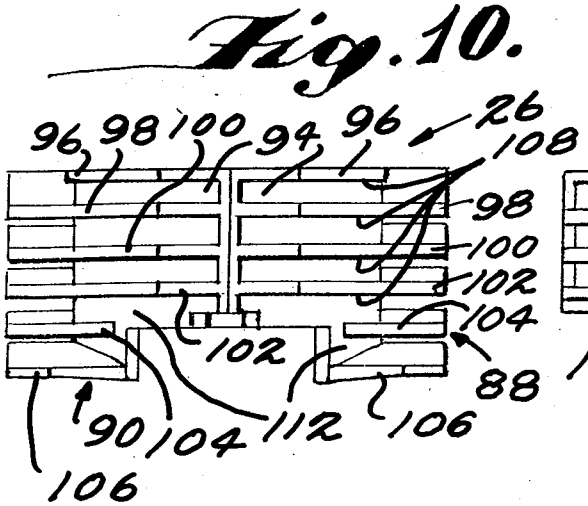
FIG. 10 is a front elevational view of the drive spoon.
Figure 12:
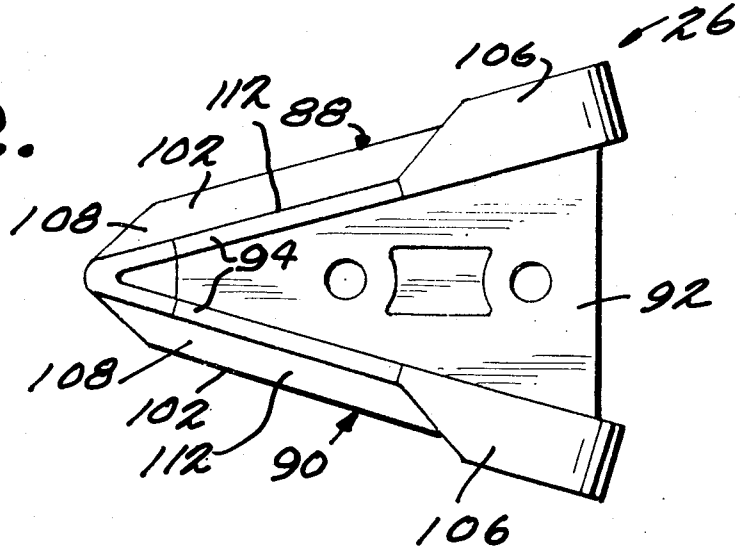
FIG. 12 is a bottom view of the drive spoon.

As best shown in FIGS. 1 through 4, the yoke 22 includes a capped vertical sleeve portion 36 which is suitably journaled on a rigid shaft 38 (see FIG. 2) suitably welded to the exterior of the barrel 18 along with a mounting plate 40 as shown in FIG. 4. The yoke 22 also includes a horizontal sleeve portion 42 which is rigidly joined with the vertical sleeve portion 36 at its forward side. The horizontal sleeve portion 42 receives a cross-shaft 44 therein as by a pair of cone mounting elements 46, as shown in FIG. 3. The yoke 22 also includes an inwardly extending lever arm portion 48 which forms a part of the overcenter spring toggle mechanism 34.

The impulse arm assembly 24 includes a pair of spaced parallel arm portions 50 each of which includes an intermediate hub portion 52 for receiving a bearing assembly 54 serving to mount the impulse arm assemby 24 on the ends of the shaft 44. Journaled on the shaft 44 between one of the hub portions 52 and the sleeve portion 42 is a counterweight assembly, generally indicated at 56. As best shown in FIG. 4, the yoke 22 includes a horizontally projecting ledge portion 58 which has an apertured boss for receiving a resilient pad 60. The counterweight assembly 56 includes a hub portion 62 for receiving a suitable bearing assembly 64 by which the counterweight assembly 56 is pivotally mounted to the shaft 44. Extending inwardly from the hub portion 62 along the barrel 18 in an upstream direction is an arm portion 66. Formed on the upper inner surface of the arm of the arm portion 66 is a ledge portion 68 which serves to engage the pad 60 so as to retain the counterweight assembly in a normal inoperative position wherein its weight is supported by the yoke 22. In addition, the ledge portion 68 serves to receive stop 70 mounted in a rearward cross position 72 extending between the rearward ends of the two impulse arm portions 50. The cross portion 72 also includes an adjustable weight 74 which is sufficient to normally bias the impulse arm assembly 24 into a position wherein the stop bolt 70 engages the ledge portion 68 and the drive spoon 26 is disposed a maximum extent into the stream issuing from the nozzle 20.

Formed integrally on the inner surface of the arm portion 50 adjacent the counterweight assembly 56 is a lug 76 which is aperatured to receive a resilient stop pad 78. This resilient stop pad 78 is adapted to engage a transversely extending abutment block portion 80 formed as an integral part of the counterweight arm portion 66. As best shown in FIG. 4, when the impulse arm assembly 24 moves in a clockwise direction away from its normally biased position through a predetermined angular movement, the resilient stop pad 78 will engage the abutment block portion 80 so that further movement of the impulse arm assembly 24 in a counterclockwise direction will carry with it the counterweight assembly 56 in load supporting relation. It will be noted that the ledge portion 58 of the yoke assembly 22 is formed with an abutment surface 82 which is disposed in a position to be engaged by the abutment block portion 80 when the counterweight assembly 56 has been moved by the impulse arm assembly 24 through a predetermined further angular distance in the clockwise direction, as viewed in FIG. 4. The engagement of the abutment surface 82 by the abutment block portion 80 serves as a positive stop against further movement in a clockwise direction of the impulse arm assembly 24 and constitutes the other limiting position thereof.

The forward ends of the arm portions 50 are joined by an integral cross portion 84 formed with a forwardly extending mounting boss on which the drive spoon 26 is removably attached, as by bolts 86.

Referring now more particularly to FIGS. 8–12 of the drawings, the drive spoon 26 is preferably in the form of a single acetal plastic molding which provides angularly related first and second reactant elements 88 and 90 rigidly interconnected by a mounting section 92 formed with suitable ribs and bosses to provide an effective means for stably receiving the mounting bolts 86 and retaining the reactant elements 88 and 90 in an angular relation with respect to one another which diverges in the direction the stream issues from the nozzle 20.

Each reactant element 88 and 90 includes an angular wall 94. Extending outwardly from each wall 94 in generally perpendicular relation thereto is a set of six vanes 96, 98, 100, 102, 104 and 106. Each set of vanes is spaced on the associated wall 94 in the direction of movement of the associated reactant element 88 or 90 into the stream issuing from the nozzle 20. Each upper or leading vane 96 is disposed in the central upper portion of the associated wall 94 and is generally straight through its extent. The next three vanes 98, 100, and 102 of each set extend substantially throughout the entire length of the associated wall 94 and include an inner, relatively long, straight portion generally parallel to the straight upper vane 96 and an outer, relatively short but wider portion which curves upwardly and outwardly from the outer end of the straight portion. The lower two vanes 104 and 106 of each set are disposed in the outer lower end portion of the associated wall 94 and each includes a short straight inner portion and a wider outer portion which curves upwardly and outwardly therefrom.

As previously indicated, when the impulse arm assembly 24 is in its normally biased limiting position, the drive spoon 26 is disposed in a position to be engaged when a stream issues from the nozzle 20. When the yoke 22 and impulse arm assembly 24 are disposed in a first operating position, as shown in FIG. 1, reactant element 88 is the part of the drive spoon 26 engaged by the stream. When the yoke 22 and impulse arm assembly 24 are moved into the other operating position, as shown in FIG. 3, reactant element 90 is the part of the drive spoon 26 engaged by the stream.

When reactant element 88 or 90 is the operating part of the drive spoon, the underside of the upper vane 96 thereof and the undersides of the straight portions of the vanes 98, 100, and 102 thereof provide reentrant surfaces 108 which are disposed at an angle of approximately 4° with respect to the direction of flow of the stream when in its limiting position, these surfaces providing reactant areas which, when engaged by the stream, provide a force component in a direction tangential to the oscillatory axis D of the impulse arm assembly tending to move the reactant element into the stream. The upper sides of the curved portions of the vanes 98, 100, 102, 104 and 106 provide impulse surfaces, indicated at 110, disposed radially outwardly from the reentrant surfaces which are adapted to receive the water flowing from the reentrant surfaces 108 immediately thereafter. The impulse surfaces 110 provide reactant areas which, when engaged by the stream by virtue of their greater angle due to the curvature thereof establish a greater force component tangential to the oscillatory axis D of the impulse arm assembly 24 tending to move the impulse arm assembly away from the stream. Since this greater force acts through a greater lever arm than the force tending to move the reactant element into the stream there is a net component force tangential to the oscillatory axis D of the impulse arm assembly 24 which will effect the impulse stroke thereof. Moreover, as can be seen from FIGS. 7–12, the curved portions of the vanes 98, 100, 102, 104, and 106 providing the impulse surfaces 110 are somewhat wider than the straight portions of the vanes and the upper vane 96 which provides the reentrant surfaces 108.

The side of the wall 94 of the operating reactant element 88 or 90 adjacent the vanes presents a series of sprinkler head rotating surfaces 112 extending between the vanes which, when the operating reactant element 88 or 90 is disposed in its normally biased position, is disposed at an angle of approximately 12° with respect to the direction of flow of the stream. The surfaces 112 define an included angle therebetween of approximately 31.50°. The surfaces 112 of the reactant element 88 provide reactant areas which, when engaged by the stream, establish a force component tangential to the rotational axis A of the sprinkler body tending to move the sprinkler body 14 in a counterclockwise direction as viewed in FIG. 3, whereas the surfaces 112 of the reactant element 92 tend to move the sprinkler body in a clockwise direction.

As best shown in FIGS. 1–3, the actuating assembly 28 is pivotally mounted on a shaft 114 which is fixedly carried by the elbow 16 with its axis B perpendicular to the longitudinal axis of the barrel 18. The actuating assembly 28 includes a central hub portion 116 which is suitably journaled on the shaft 114, as by bearing assemblies 118, and an angular lever arm portion 120 which extends rearwardly and downwardly from the hub portion 116. The lower free end portion of the lever arm portion 120 carries a stop engaging roller 122.

It can be seen that in either limiting position of the actuating assembly 28, the roller 120 will be disposed in a position such that its arcuate movement about the rotational axis A of the sprinkler body 14 when the latter is rotated is within a plane suitable to engage either the first position selecting assembly 30 or the second position selecting assembly 32.

As best shown in FIGS. 1–3, the first and second position selecting assemblies 30 and 32 are of substantially identical construction except that they are mirror images of one another. As shown, each position selecting assembly 30 or 32 includes an upper abutment plate member 124 presenting an abutment edge 126 facing in a direction to be engaged by the roller 122 and a separate lower mounting plate member 128. Each upper plate member 124 is formed with an arcuate groove on its lower surface for engaging a mounting ring 130 formed on the stationary housing assembly 12. The associated lower mounting plate member 128 includes an upwardly opening arcuate groove for engaging the mounting ring 130. Bolts 132 serve to secure each pair of cooperating members 124 and 128 together in fixed relation with respect to the ring 130. It will be understood however that by loosening the bolts 132 the associated two cooperating members 124 and 128 will be moved away from one another enabling the associated position selecting assembly 30 or 32 to be moved into any desired position of adjustment along the ring where it can be fixed by retightening the associated bolts 132.

It will be noted that each upper plate member 124 includes an upwardly projecting stop block portion 134 which is adapted to engage a rearwardly extending abutment 136 formed integrally on the elbow 16. With this arrangement, a positive limitation with respect to the movement of the sprinkler body 14 about its vertical axis A with respect to the stationary housing assembly 12 is provided. Before the interengagement of the stop block portion with the stop abutment 136, roller 122 will have engaged the associated surface 126 so as to be moved from the position in which it has been into its opposite position.

The actuating assembly 28 also includes a forwardly extending bifurcated lever arm portion 138 which forms a part of the overcenter resilient toggle mechanism 34. The forward bifurcated ends of the lever arm portion 138 are apertured to receive a pivot pin 140 which extends through a cylindrical block 142 slidably mounted within the end of a tube 144. The adjacent end of the tube 144 is formed with a pair of elongated slots 146 which receive the pivot pin. Mounted within the tube 144 forwardly of the cylindrical block 142 is a compression coil spring 148, the forward end of which engages a block 150 which is fixed within the forward end of the tube 144. The forward end of the tube 144 and block 150 are formed with registered openings which receive a pivot pin 152 fixed to and extending upwardly from the rearward end of the lever arm portion 48 of the yoke 22. As previously indicated, this lever arm portion 48 forms a part of the overcenter spring toggle mechanism 34.

It will be noted that opposite sides of the rearward end of the lever arm portion 48 are apertured and threaded to receive two set screw elements 154 which are adapted to abuttingly engage the legs of an inverted U-shaped bracket 156 fixed to the sprinkler body 14 at a position above and adjacent the juncture between the elbow 16 and the barrel 18. The arrangement of the U-shaped bracket 156 is such as to provide accurate positioning of the yoke 22 and impulse arm assembly 24 carried thereby in its two operating positions so that the drive spoon 26 will be accurately positioned with respect to the stream issuing from the nozzle 20.

Accuracy in the arrangement is insured by virtue of the provisions of the two set screw elements 154 and the fact that they can be adjusted with respect to the sides of the lever arm portion 48.

OPERATION

With the above in mind, a typical operation of the sprinkler head 10 will now be described beginning with the parts disposed in the position shown in FIG. 1. Yoke 22 is in its first operating position and so is the impulse arm assembly 24 wherein the reactant element 88 is disposed in a position to receive the stream issuing from the nozzle 20 when the sprinkler head is communicated with water under pressure. As previously indicated ,this position of the drive spoon 26 is assured by virtue of the fact that the impulse arm assembly 24 is weight biased to move about shaft 44 in a counterclockwise direction, as viewed in FIG. 4 so that stop screw 70 will engage ledge portion 68 of the counterweight assembly 56 which in turn is held against movement by virtue of the engagement with stop button 60 carried by the yoke 22. It will also be noted that the actuating assembly 28 is in a first limiting position in which movement in a clockwise direction as viewed in FIG. 1 can be effected whereas further movement in the counterclockwise direction can not be effected. Upon communication of the sprinkling head 10 with the source of water under pressure, the stream will issue from the nozzle 20 and impinge upon the reactant element 88. The impingement of the water stream on the reactant element 88 creates, as aforesaid, two impulse force components, one by virtue of the surfaces 112 which acts in a tangential direction with respect to the vertical axis of rotation A of the sprinkler body 14 so as to effect a stepped rotational movement thereof in a counterclockwise direction as viewed in FIG. 1 and the other by virtue of the surfaces 110 an impulse force component acting in a direction tangential to the oscillatory axis D of the shaft 44 which tends to move the impulse arm assembly 24 in a counterclockwise direction as viewed in FIG. 1. As the impulse arm assembly 24 is moved through a predetermined distance in a counterclockwise direction it will pick up the counterweight assembly 56 by virtue of the engagement of the bolt 78 with the abutment block 80 thereof and eventually its movement will be brought to a halt by virtue of the counterbalancing weight of counterweight assembly. The counterbalancing weight then serves to reverse the direction of movement of the impulse arm 24 so that the counterweight is moved back into its limiting position and ultimately the impulse arm assembly 24 with the reactant element 88 is again brought into contact with the stream issuing from the nozzle 20.

As previously indicated, the arrangement is such that as the velocity or energy level of the stream goes down, more surface area of the reactant surfaces 108, 110 and 112 of the reactant element 88 will be engaged with the stream. Conversely, as the energy level of the stream issuing from the nozzle increases, the reactant element 88 will enter the stream a lesser distance thus presenting less reactant surface area for engagement so that a substantially constant continuous oscillatory cyclical movement to the impulse arm assembly 24 takes place irrespective of the energy level changes that may occur in the stream.

During each oscillatory cycle of the impulse arm assembly 24 a stepped or short rotational movement of the sprinkler body 14 takes place by virtue of the surfaces 112 of the reactant element 88 being engaged by the stream. This step by step counterclockwise movement of the sprinkler body 14 will continue until such time as the roller 122 of the actuating assembly 28 engages the first position selecting assembly 30 or specifically the leading edge 126 of the upper plate member 124 thereof. After the roller 122 engages the edge 126, further step by step counterclockwise movement of the sprinkler body 14 results in a relative clockwise movement of the lever arm 138 about its axis with respect to the sprinkler body 14. During this relative movement, spring 142 is compressed until the toggle linkage represented by the arm 138 and tube 144 assumes a centered or aligned relationship. After the toggle linkage moves overcenter on past its aligned postion, spring 142 is operable to bias the toggle linkage toward its opposite position.

Thus, it can be seen that the operation of the resilient overcenter toggle mechanism 34 is such that as the actuating lever arm 138 moves into an overcenter position, spring 148 will serve to move both the lever arm portion 138 and the lever arm portion 48 of the yoke the rest of the way into the second operating position. This operating position is shown in FIG. 3 and it will be noted the drive spoon 26 is now in a position such that the stream issuing from the nozzle 20 will impinge upon the reactant element 90. The impingement of the stream on the reactant element 90 similarly establishes two impulse force components one of which establishes the continuous oscillatory movement of the impulse arm assembly 24 and the other of which effects the step by step movement of the sprinkler body 14 about its vertical axis A this time in a clockwise direction, as viewed in FIG. 3. This clockwise movement will continue until the forward edge 126 of the second position selecting assembly 32 is engaged by the roller 122 to an extent sufficient to effect an overcenter movement of the actuating assembly 28 at which point the overcenter spring toggle mechanism 34 completes the movement of the actuating assembly 28 together with the yoke 22 and the impulse arm assembly 24 into their second operating positions carried thereby. The sprinkler head 10, then moves counterclockwise back into the position shown in FIG. 1 to complete the cycle.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a sprinkler head comprising a sprinkler body having an inlet and an outlet, means for mounting said sprinkler body for controlled rotational movement about a generally vertical axis with said inlet in communication wtih a conduit arranged to communicate a source of water under pressure therewith, said outlet being disposed to direct water under pressure communicated with said inlet in a stream flowing therefrom in a direction upwardly and outwardly with respect thereto in generally symmetrical relation to a plane passing through the axis of rotation, an impulse arm, means pivotally mounting said impulse arm with respect to said sprinkler body (1) for pivotal movement about an axis disposed within said plane between a selected first or second operating position and (2) for operative oscillating movement about an axis extending transverse to said plane, said impulse arm having a drive spoon operable when said impulse arm is in said first and second operating positions respectively for effecting rotational movements of said sprinkler body in clockwise and counter clockwise directions respectively, said impulse are being normally biased toward an oscillatory limited position wherein an operable reactant element is disposed within the path of a stream issuing from said outlet a predetermined maximum extent and being operable in response to the energy of a stream issuing from said outlet to move through repeated oscillatory cycles each of which includes an impulse stroke wherein said operable reactant element leaves the stream and moves away from the latter in one direction and a return stroke wherein said operable reactant element moves in the opposite direction toward said stream and enters the latter, and means operable (1) when said impulse arm is in said first operating position and said sprinkler body has been rotated clockwise into a first rotational limiting position for changing the selected position of said impulse arm from said first operating position to said second operating position and (2) when said drive spoon is in said second operating position and said sprinkler body has been rotated counter clockwise into a second rotational limiting position for changing the selected position of said impulse arm from said second operating position to said first operating position, the improvement which comprises said sprinkler body including an elongated barrel leading to said outlet having a longitudinal axis intersecting at an included angle greater than 90° with the rotational axis of said sprinkler body, the pivotal axis of said impulse arm being upright and at a position spaced substantially outwardly in a downstream direction from the intersection of said longitudinal axis with said sprinkler body rotational axis, said impulse arm mounting means including a yoke pivotally mounted on said barrel about an axis coinciding with the pivotal axis of said impulse arm for movement between first and second operating positions corresponding to the first and second operating positions of said impulse arm and means for pivotally connecting said impulse arm with said yoke about an axis constituting the oscillating axis of said impulse arm, the oscillating axis of said impulse are being disposed above the longitudinal axis of said barrel and spaced outwardly of the yoke pivotal axis in a downstream direction.

2. The improvement as defined in claim 1 wherein said selected position changing means includes first position selecting means adjustably connected to said sprinkler body for determining said first rotational limiting position, second position selecting means adjustably connected with said sprinkler body mounting means for determining said second rotational limiting position, an actuating member mounted on said sprinkler body for movement from a first actuating position into a second actuating position in response to the engagement of said second position selecting means and from said second actuating position into said first actuating position in response to the engagement of said first position selecting means, and resilient overcenter biasing means for (1) moving said yoke from said first operating position into said second operating position and biasing the same therein in response to the movement of said actuating member from said first actuating position into said second actuating position and (2) moving said yoke from said second operating position into said first operating position and biasing the same therein in response to the movement of said actuating member from said second actuating position into said first actuating position.

3. The improvement as defined in claim 2 wherein said actuating member is pivoted about an axis parallel with the pivotal axis of said yoke and spaced inwardly therefrom in an upstream direction, said actuating member including a stop engaging arm disposed on the opposite side of the axis of said actuating member from the yoke axis.

4. The improvement as defined in claim 3 wherein said resilient overcenter biasing means includes a first lever arm fixed with respect to said actuating member and extending outwardly in a downstream direction from the pivotal axis thereof, a second lever arm fixed to said yoke and extending inwardly therefrom in an upstream direction from the pivotal axis thereof, and variable length spring means interconnecting said first and second lever arms.

5. The improvement as defined in claim 4 including counterweight means mounted on said yoke for independent pivotal movement about the oscillating axis of said impulse arm toward and away from a normal weight biased position wherein the weight of the counterweight means is borne by said yoke, and means on said impulse arm for engaging said counterweight means in weight bearing relation and moving the same toward and away from the normal position thereof when said impulse arm moves respectively toward and away from a predetermined position spaced from the oscillatory limiting position thereof.

6. The improvement as defined in claim 5 wherein said counterweight means includes a counterweight arm extending inwardly in an upstream direction from said impulse arm oscillating axis when in said normal position.

7. The improvement as defined in claim 1 including counterweight means mounted on said yoke for independent pivotal movement about the oscillating axis of said impulse arm toward and away from a normal weight biased position wherein the weight of the counterweight means is borne by said yoke, and means on said impulse arm for engaging said counterweight means in weight bearing relation and moving the same toward and away from the normal position thereof when said impulse arm moves respectively toward and away from a predetermined position spaced from the oscillatory limiting position thereof.

8. The improvement as defined in claim 7 wherein said counterweight means includes a counterweight arm extending inwardly in an upstream direction from said impulse arm oscillating axis when in said normal position.

9. The improvement as defined in claim 1 wherein said drive spoon includes first and second reactant elements angularly related with respect to one another in diverging relation with respect to one another in the direction the stream flows from said outlet, said first reactant element including first arm oscillating surface means fixed with respect to said arm to provide a reactant area engaged by the stream which increases as the extent of entry of said first reactant element within said stream approaches said maximum extent so that the product of the energy level of the stream and the reactant area of said first arm oscillating surface means engaged thereby establishes an impulse force having a component tangential to the oscillating axis of said arm for effecting the impulse stroke thereof which is maintained generally constant by varying the extent of entry of said first reactant element within said stream in reponse to variation in the pressure of the source of water under pressure and hence by increasing or decreasing the reactant area of said first arm oscillating surface means in response to a decrease or increase in the energy level of the stream engaged thereby, said first reactant element also including first sprinkler body rotating surface means fixed with respect to said arm to provide a reactant area engaged by the stream which increases as the extent of entry of said first reactant element within said stream approaches said maximum extent so that the product of the energy level of the stream and the reactant area of said first body rotating surface means engaged thereby establishes an impulse force having a component tangential to the rotational axis of said body for effecting an incremental rotational movement thereof in a clockwise direction which is maintained generally constant by varying the extent of entry of said first reactant element within said stream in response to variation in the pressure of the source of water under pressure and hence by increasing or decreasing the reactant area of said first body rotating surface means in response to a decrease or increase in the energy level of the stream engaged thereby, said second reactant element including second arm oscillating surface means fixed with respect to said arm to provide a reactant area engaged by the stream which increases as the extent of entry of said second reactant element within said stream approaches said maximum extent so that the product of the energy level of the stream and the reactant area of said second arm oscillating surface means engaged thereby establishes an impulse force having a component tangential to the oscillating axis of said arm for effecting the impulse stroke thereof which is maintained generally constant by varying the extent of entry of said second reactant element within said stream in reponse to variation in the pressure of the source of water under pressure and hence by increasing or decreasing the reactant area of said second arm oscillating surface means in response to a decrease or increase in the energy level of the stream engaged thereby, and said second reactant element also including second sprinkler body rotating surface means fixed with respect to said arm to provide a reactant area engaged by the stream which increases as the extent of entry of said second reactant element within said stream approaches said maximum extent so that the product of the energy level of the stream and the reactant area of said second body rotating surface means engaged thereby establishes an impulse force having a component tangential to the rotational axis of said body for effecting an incremental rotational movement thereof in a counterclockwise direction which is maintained generally constant by varying the extent of entry of said reactant element within said stream in response to variation in the pressure of the source of water under pressure and hence by increasing or decreasing the reactant area of said second body rotating surface means in response to a decrease or increase in the energy level of the stream engaged thereby.

10. The improvement as defined in 9 wherein each of said first and second arm oscillating surface means is defined by a plurality of vanes spaced in the direction of movement of the associated reactant element with said stream.

11. The improvement as defined in claim 10 wherein each of said plurality of vanes includes first surfaces facing in a direction such that when engaged by the stream said first surfaces will cause the associated reactant element to move into said stream and second surfaces spaced outwardly of the associated first surfaces in a position to receive thereon the portion of the stream deflecting therefrom, each of second surfaces facing in a direction opposed to the associated first surfaces such that when engaged by the stream said second surfaces will cause the associated reactant element to move in the opposite direction.

12. The improvement as defined in claim 10 wherein each of said first and second sprinkler body rotating surface means is defined by a wall connecting the associated plurality of vanes along one side thereof, the included angle between the sprinkler body rotating surface means defined by said walls being approximately 31.5°.

13. The improvement as defined in claim 12 wherein each plurality of vanes includes an upper generally straight vane extending generally perpendicular to the associated wall, three vanes spaced below the associated upper vane each including a straight portion generally parallel with the associated upper vane and a curved outer portion extending upwardly and outwardly from the outer end of the straight portion, the underside of each upper vane and the straight portions of the associated two lower vanes immediately therebelow providing the associated first surfaces and the upperside of the associated curved portions providing the associated second surfaces.

* * * * *